United States Patent [19]

Szulczewski et al.

[11] Patent Number: 4,968,227

[45] Date of Patent: Nov. 6, 1990

[54] VARIABLE DISPLACEMENT FLUID PUMP WITH IMPROVED WIDEBAND NEUTRAL

[75] Inventors: Dennis E. Szulczewski, Eden Prairie, Minn.; James M. Casey, Spencer, Iowa; Mark S. Jennen, Eden Prairie, Minn.

[73] Assignee: Eaton Corporation, Cleveland, Ohio

[21] Appl. No.: 448,403

[22] Filed: Dec. 11, 1989

[51] Int. Cl.[5] ..... F04B 1/10

[52] U.S. Cl. ..... 417/440; 91/497

[58] Field of Search ..... 417/221, 440, 441, 462; 92/12.1, 148; 91/497

[56] References Cited

U.S. PATENT DOCUMENTS

| | | | |
|---|---|---|---|
| 3,020,890 | 2/1962 | Grad | 91/497 |
| 3,022,741 | 2/1962 | Brundage | 417/440 X |
| 4,091,717 | 5/1978 | Bojas et al. | 91/498 |

*Primary Examiner*—John C. Fox
*Attorney, Agent, or Firm*—L. J. Kasper

[57] ABSTRACT

A variable displacement, rotary fluid pressure pump (11) is disclosed of the type having a cam ring member (25) which is movable, in response to rotation of a control shaft (35), between a neutral position (FIG. 5) and a displaced position (FIG. 4). The pump housing (13, 15) includes a support member (25), and they cooperate to define a high-pressure fluid passage (51). In communication with the passage (51) is a recess (71), in which is disposed a dampening shoe (73). The dampening shoe is biased by high-pressure fluid in the passage (51) into engagement with an adjacent surface (77) of the cam ring (25). The surface (77) defines a neutral fluid passage (79), and the dampening shoe (73) defines a restricted opening (85). When the cam ring (25) is in the displaced position, the restricted opening (85) is blocked from communication with the neutral passage (79), but as the cam ring is returned to its neutral position, the opening (85) begins to communicate with the neutral passage (79), thus providing the pump with an increased neutral band overlap.

9 Claims, 4 Drawing Sheets

FIG. 4
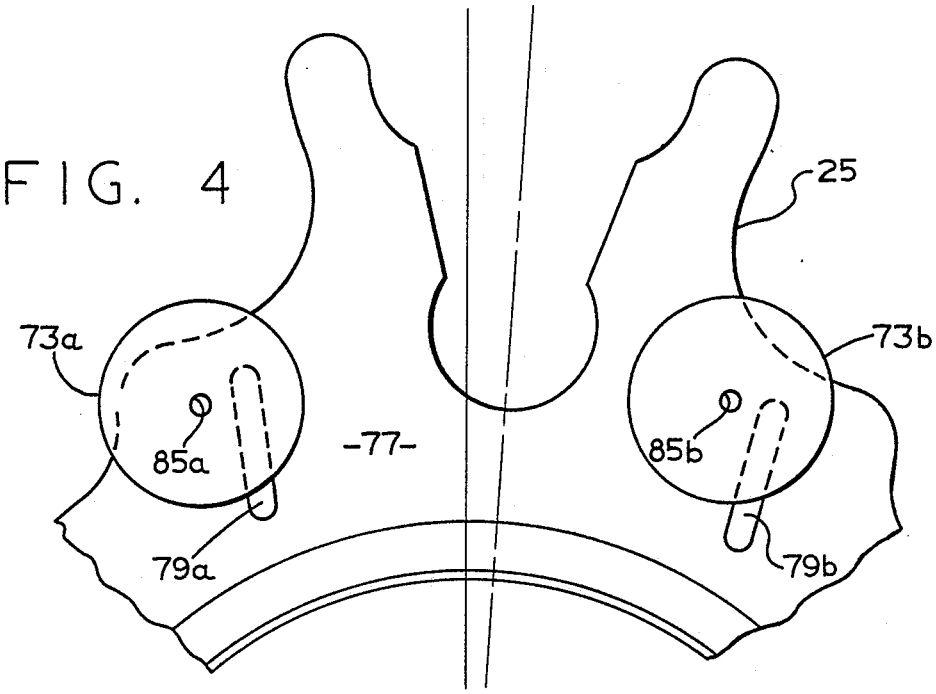
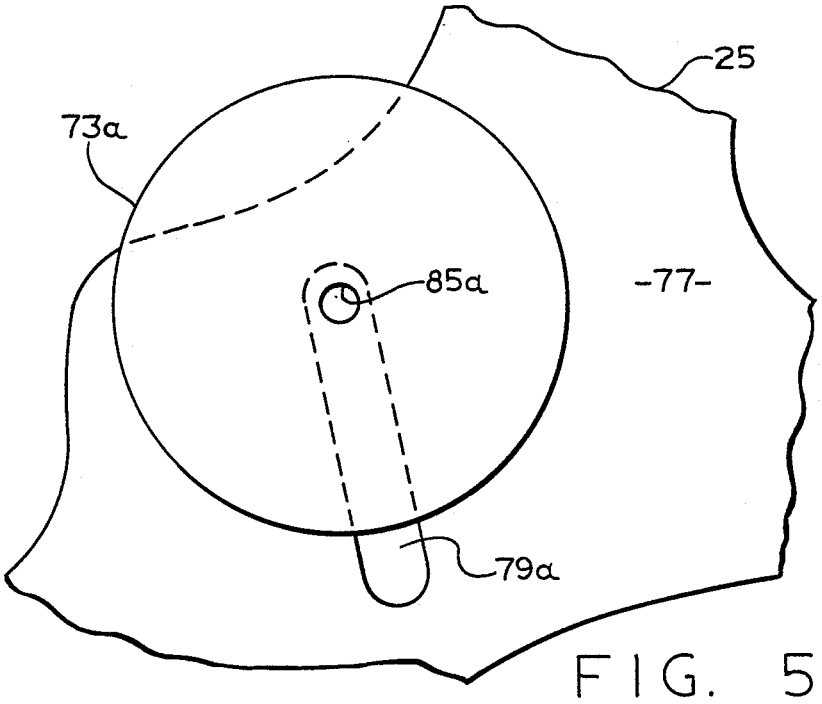
FIG. 5

VARIABLE DISPLACEMENT FLUID PUMP WITH IMPROVED WIDEBAND NEUTRAL

BACKGROUND OF THE DISCLOSURE

The present invention relates to variable displacement, rotary fluid pressure pumps, and more particularly, to such pumps of the type which include a cam ring which is movable between a neutral position and a displaced position.

Although the present invention may be utilized in connection with a variety of fluid pumps, it is especially advantageous when used in connection with pumps of the radial piston/radial ball type, and will be described in connection therewith.

Variable displacement radial ball and radial piston pumps are used in a variety of applications, typically in conjunction with some form of fluid motor, to comprise a hydrostatic transmission, or in conjunction with a pair of fluid motors to comprise a hydrostatic transaxle. In either case, a typical application is to propel relatively small vehicles such as lawn and garden tractors.

One of the problems associated with such transmissions and transaxles for many years has been the difficulty of returning the pump to its neutral position, from its displaced position (i.e., either forward or reverse). Typically, controlling the displacement of such pumps is accomplished by rotation of a manual control shaft which, in turn, moves the cam ring of the pump element.

If the vehicle operator sets the control shaft in what he believes is the neutral position, but has not achieved perfect neutral, and then gets off of the vehicle, the vehicle may thereafter begin to move or "creep", because the pump is still putting out just enough pressurized fluid to rotate the motor of the transmission or the motors of the transaxle. The occurrence of such movement has long been recognized as an undesirable operating condition, and those skilled in the art have attempted various solutions for the problem associated with the pumping element not being in its perfectly neutral position, even when the control shaft seems to be in its neutral position.

SUMMARY OF THE INVENTION

Accordingly, it is an object of the present invention to provide an approved variable displacement, rotary fluid pressure pump having an increased neutral band overlap to overcome the above-described problems.

It is a further object of the present invention to provide a rotary fluid pressure pump which achieves the above-stated object without the need for substantial redesign, or the need for substantial additional components and controls.

The above and other objects of the invention are accomplished by the provision of an improved variable displacement, rotary fluid pressure pump of the type including a housing assembly defining a pump cavity, and a pair of confronting, axially spaced transverse housing surfaces. A cam ring member is disposed between the transverse surfaces and defines a generally annular cam surface, the cam ring member being movable to define a neutral position and a displaced position. A rotor assembly is disposed within the cam ring member and defines a plurality of circumferentially-spaced, radially-extending bores, and a piston member is disposed in each of the bores. The housing assembly includes means to support the rotor assembly relative to the housing assembly, for rotation about an axis. The housing assembly and the support means cooperate to define inlet fluid passage means for directing fluid to certain of the bores, and further cooperate to define outlet fluid passage means for directing fluid from certain other of the bores.

The improved pump is characterized by the cam ring member defining a first transverse surface closely spaced apart from a first one of the transverse housing surfaces. The transverse surface of the cam ring member defines a neutral fluid passage means in fluid communication with the pump cavity of the housing assembly. The housing assembly and the support means cooperate to define a high-pressure fluid passage means in fluid communication with the outlet fluid passage means, and including a restricted opening in the transverse housing surface. The restricted opening is disposed such that, when the cam ring member is in the displaced position, fluid communication from the restricted opening to the neutral fluid passage means is substantially prevented, then as the cam ring member is displaced toward said neutral position, fluid communication from the restricted opening to the neutral fluid passage means is gradually opened.

BRIEF DESCRIPTION OF THE DRAWINGS

FIGS. 4 and 5 are enlarged, somewhat schematic, transverse views, similar to FIG. 2, but viewed in the opposite direction, illustrating the present invention at various displacements of the cam ring.

DESCRIPTION OF THE PREFERRED EMBODIMENT

Figure 1:
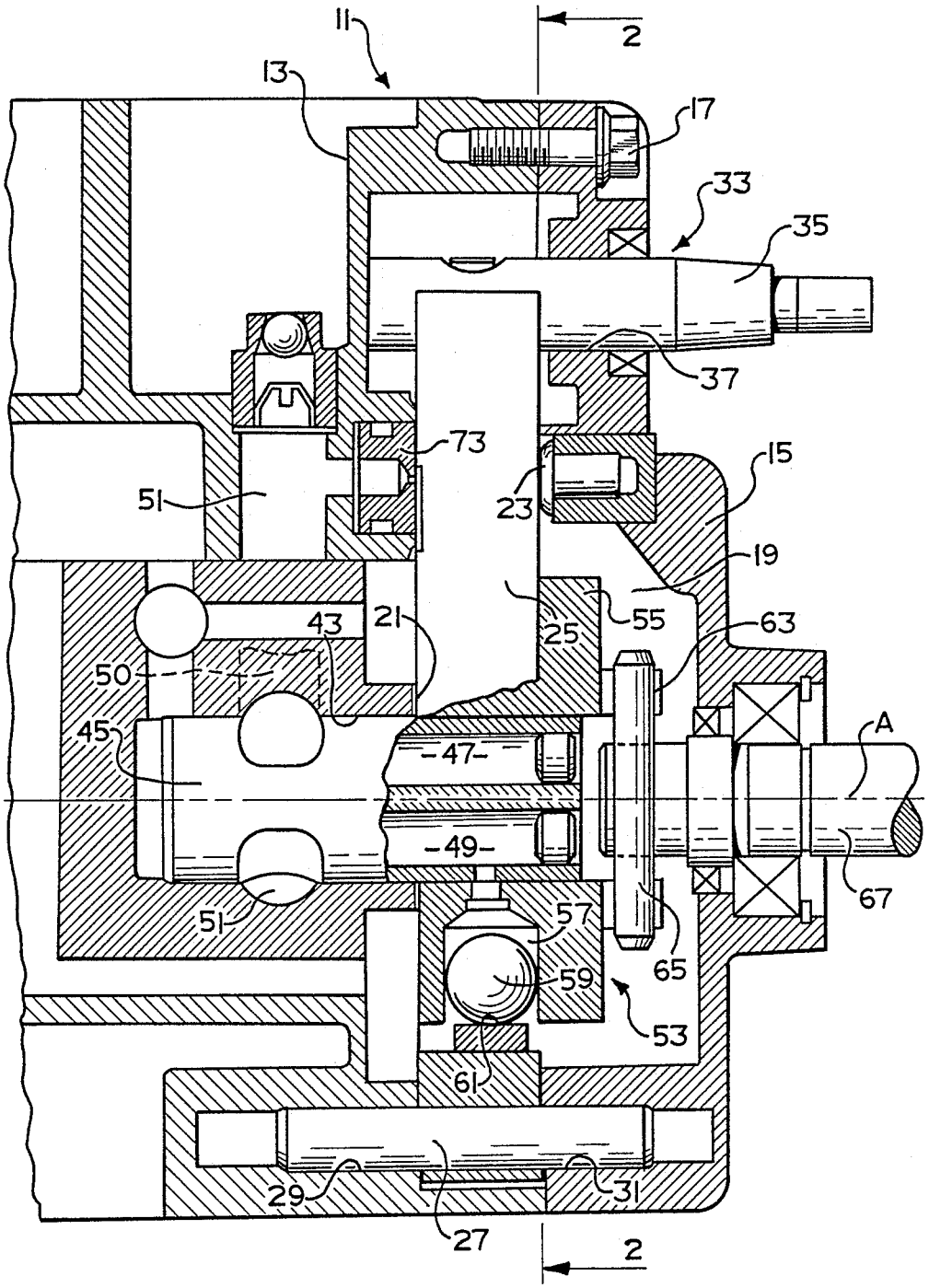
FIG. 1 is an axial cross-section of a variable displacement, radial ball pump of the type with which the present invention may be utilized, taken partly on line 1—1 of FIG. 2.

Referring now to the drawings, which are not intended to limit the present invention, FIG. 1 illustrates a variable displacement, radial ball hydrostatic pump of the general type which is illustrated and described in U.S. Pat. No. 4,091,717, assigned to the assignee of the present invention and incorporated herein by reference.

The specific pump design illustrated in FIG. 1 is that used in conjunction with the Model 750/850 hydrostatic transaxle manufactured and sold by Eaton Corporation.

The variable displacement, radial ball pump of FIG. 1, generally designated 11, includes a body 13 and a cover member 15, the cover member 15 being attached to the body 13 by means of a plurality of bolts 17. The body 13 and cover member 15 cooperate to define a pump cavity 19, defined by a pair of confronting, axially-spaced transverse housing surfaces, including surface 21 defined by body 13, and surface 23, defined by cover member 15.

Figure 2:
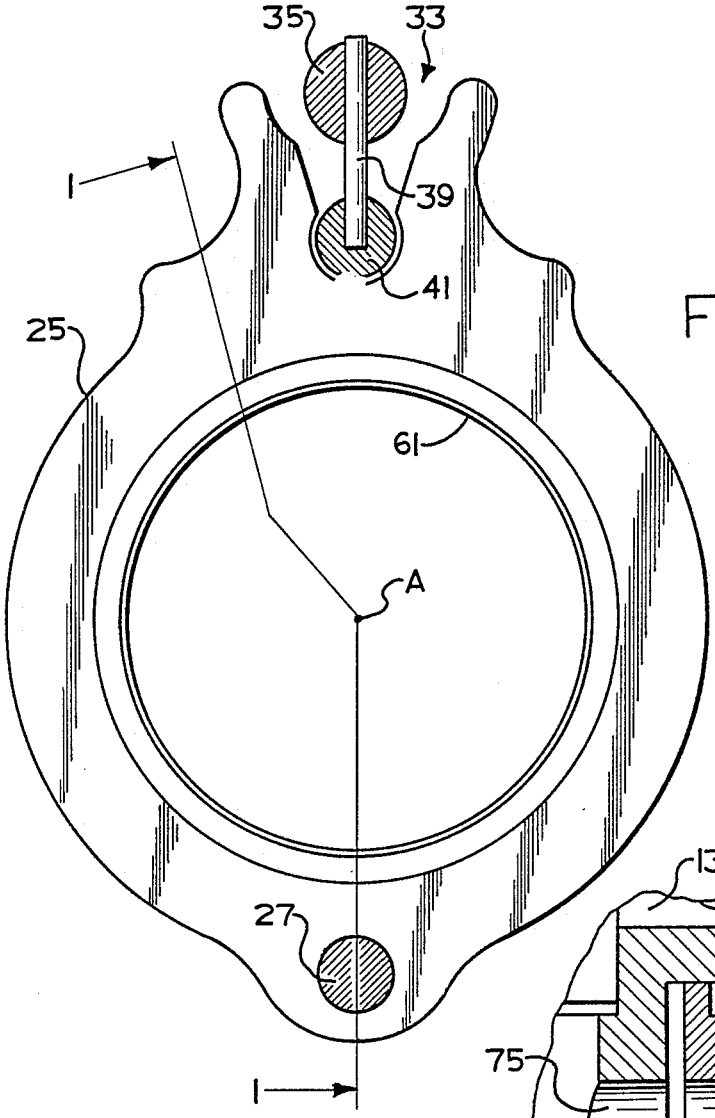
FIG. 2 is a transverse cross-section, taken on line 2—2 of FIG. 1, showing only the cam ring and associated structure.

Referring now to FIG. 2, in conjunction with FIG. 1, disposed in the pump cavity 19 is a cam ring 25 which is disposed to pivot about the axis of a cam pivot pin 27. The pivot pin 27 is received within a pair of aligned bores 29 and 31, defined by the body 13 and cover 15, respectively. Pivotal movement of the cam ring 25 about the axis of the pin 27 is accomplished by means of a control assembly, generally designated 33. The control assembly 33 includes a control shaft 35, which is rotatably received within an opening 37 defined by the cover member 15. The outer end (right end in FIG. 1) of the control shaft 35 is threaded for attachment of appropriate control linkage (not shown). The inner end of the control shaft 35 has extending diametrally therethrough a control pin 39, the radially-inner end of which is received in a generally cylindrical cam ring insert 41, such that rotation of the control shaft 35 about its axis results in pivotal movement of the insert 41, and therefore, pivotal movement of the cam ring 25 about the axis of the pivot pin 27.

The body 13 defines a generally cylindrical bore 43, within which is press-fit a cylindrical support member 45. The member 45 defines a pair of axially-extending bores 47 and 49, the bore 47 comprising a low-pressure inlet passage, and the bore 49 comprising a high-pressure outlet passage. The support member 45 and body 13 cooperate to define a high-pressure passage 51, seen in FIG. 1 both beneath and above the support member 45. It may be seen in FIG. 2 that FIG. 1 is taken on a diametral section, with regard to the control assembly 33, but is taken on line 1—1 with regard to the high-pressure passage 51.

Surrounding the support member 45, and disposed within the cam ring 25 is a rotor assembly, generally designated 53, including a rotor member 55 which is journalled on the support member 45 and defines a plurality of circumferentially-spaced, radially-extending cylinder bores 57. Disposed in each of the bores 57 is a piston or ball 59, the balls 59 being in engagement with, and restrained in the radial travel by a concave race surface 61.

The forward end (right end in FIG. 1) of the rotor member 55 includes a pair of cut-out portions 63 which receive a transversely oriented drive pin 65. The drive pin 65 passes through the axially-inner end of an input shaft 67. The input shaft 67 extends outward (to the right in FIG. 1) through the cover member 15, is rotatably supported relative thereto, and defines an axis of rotation A.

Figure 3:
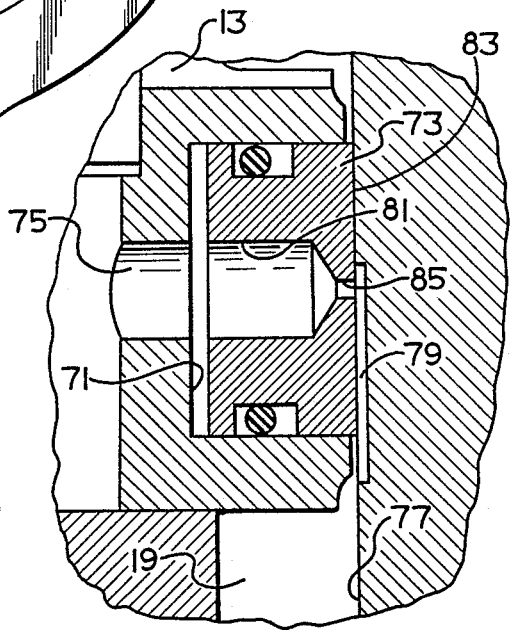
FIG. 3 is an enlarged, fragmentary view, similar to FIG. 1, illustrating one aspect of the wideband neutral feature of the present invention.

Referring now primarily to FIG. 3, in conjunction with FIG. 1, the body 13 defines a pair of generally cylindrical recesses 71 (only one of which is shown in FIG. 1), and disposed in each of the recesses 71 is a dampening piston or shoe 73. Adjacent the shoe 73, the body 13 defines a passage 75 which provides communication from the high-pressure passage 51 into the recess 71. The high-pressure fluid in the recess 71 biases the dampening shoe 73 against a transverse surface 77 of the cam ring 25. When high-pressure fluid is present in the recess 71, the pressure biases the dampening shoe 73 against the surface 77 which, in turn, biases the cam ring 25 against the surface 23 of the cover member 15. The primary function of the dampening shoes, as described above, is to dampen vibrations of the cam ring 25, which typically result from the high-speed rotation of the rotor assembly 53 within the cam ring 25.

To the extent that the dampening shoes 73 have already been described above, their general structure and function are illustrated and described in detail in above-incorporated U.S. Pat. No. 4,091,717. However, it is one aspect of the present invention that a modification of the dampening shoes 73 and the cam ring 25 makes it possible to achieve a wideband neutral feature of the pump 11. Referring now primarily to FIGS. 3, 4 and 5, the wideband neutral feature of the present invention will be described. The surface 77 of the cam ring 25 defines a pair of generally radially-oriented neutral fluid passages 79 which extend radially-inward beyond the dampening shoes 73, for reasons to be described subsequently.

Each of the dampening shoes 73 defines a relatively large counterbore 81, which is in open communication with fluid pressure in the recess 71. Each dampening shoe 73 includes a forward surface 83 biased into sliding engagement with the surface 77 of the cam ring 25. Communicating between the counterbore 81 and the forward surface 83 is a restricted opening 85. Referring now primarily to FIG. 4, in conjunction with FIG. 3, it may be seen that each of the restricted openings 85 is out of fluid communication with its respective neutral fluid passage 79 and therefore, whichever of the dampening shoes 73 is subjected to high pressure will be biased against the transverse surface 77, which blocks any fluid flow through the restricted opening 85. Thus, in the displaced position as shown in FIG. 4, each of the dampening shoes 73 merely performs the dampening function as described in above-incorporated U.S. Pat. No. 4,091,717.

Wideband neutral (or neutral band overlap) is defined as the range of positions of the control shaft 35 which puts the cam ring 25 into its neutral position (i.e., in terms of pressurized output flow from the pump 11) as the cam ring 25 is being moved toward the neutral position from either forward or reverse displacement. Therefore, as the cam ring 25 is moved toward its neutral position, which is shown in FIG. 5, the restricted opening 85 begins to communicate with the neutral fluid passage 79, thereby relieving some of the high-pressure fluid from the high-pressure passage 51, through the passage 75 and counterbore 81. High-pressure fluid which flows through the restricted opening 85 then flows radially-inwardly through the passage 79 and, as may best be seen in FIG. 3, is then able to flow past the radially-innermost extent of the shoe 73 and into the pump cavity 19.

The opening 85 is restricted in size, or kept relatively small, to enable the dampening shoe 73 to perform its normally dampening function, except when the cam ring 25 is very close to its neutral position. It is possible for even a relatively small opening 85 to accomplish the intended function because, when the cam ring 25 is very near its neutral position, the volume of pressurized fluid output of the pump 11 is quite small, although still capable of causing "creep" of the associated fluid motors.

By way of example only, during the development of the wideband neutral feature of the present invention, prototype hardware was produced in which the restricted opening 85 had a diameter of 0.038 inches and the neutral fluid passage 79 had a width of 0.064 inches and a depth of 0.096 inches. This particular combination of dimensions resulted in a neutral band overlap of 0.75 degrees (i.e., within 0.75 degrees of neutral, pump output pressure is less than about 100 psi.

The relatively narrow, deep fluid passage 79 described in the above example was considered potentially difficult and expensive to manufacture. Therefore, the neutral fluid passage 79 was changed to have a width of 0.090 inches and a depth of 0.032 inches. This combination resulted in a neutral band overlap of approximately 80 degrees.

Figure 6:
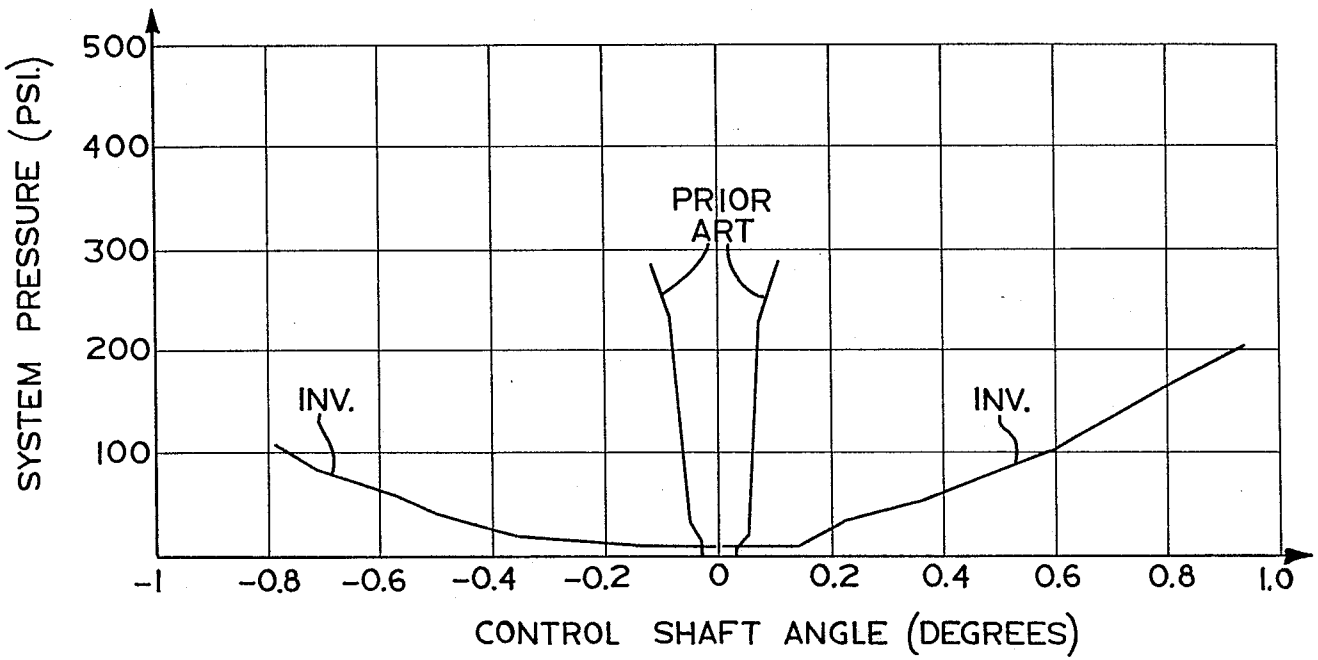
FIG. 6 is a graph of system pressure versus control shaft angle, comparing the prior art with the present invention.

Referring now to FIG. 6, there is illustrated a graph of system pressure versus control shaft angle, comparing the prior art to the present invention. In a pump without the wideband neutral feature of the present invention, system pressure is still in excess of 200 psi. until the control shaft 35 is within 0.1 degrees of neutral. By way of contrast, with the present invention, system pressure drops to approximately 100 psi. when the control shaft is within about 0.8 degrees of neutral (coming from reverse) and drops to about 100 psi. when the control shaft is within about 0.6 degrees of neutral (coming from forward).

It should be apparent to those skilled in the art that the dimensions of the restricted opening 85 and of the neutral fluid passage 79 may vary substantially from the dimensions given in the above examples, and it is believed to be well within the ability of one skilled in the art to select specific dimensions, for a particular pump application. For example, in a relatively larger pump having a relatively larger displacement per revolution of the rotor assembly 53, it would probably be necessary for both the restricted opening 85 and the neutral fluid passage 79 to be somewhat larger, in order to achieve the same neutral band overlap illustrated in FIG. 6.

As a result of the development work which occurred in connection with the present invention, it was found preferable for the restricted opening 85 to be in the range of 0.033 to 0.043 inches, with the neutral fluid passage 79 having a width in the range of 0.080 to 0.100 inches. It will be understood by those skilled in the art that the depth of the neutral fluid passage 79 is relatively less critical, and is somewhat determined by manufacturing considerations.

The wideband neutral feature of the present invention has been described in connection with an embodiment in which the restricted opening 85 is disposed in the dampening shoe 73. However, it should be apparent to those skilled in the art that such an arrangement is not an essential feature of the present invention. Instead, it is essential only that there be a restricted opening communicating between the high-pressure passage 51 and the neutral fluid passage 79, whenever the cam ring 25 approaches its neutral position. However, pressurized fluid is required to bias the dampening shoe 73 into engagement with the cam ring 25, and therefore, is a convenient location for the restricted openings 85.

The invention has been described in great detail, sufficient to enable one skilled in the art to make and use the same. Various alterations and modifications of the invention will occur to those skilled in the art upon a reading and understanding of the foregoing specification, and it is intended to include all such alterations and modifications as part of the invention, insofar as they come within the scope of the appended claims.

We claim:

1. A variable displacement, rotary fluid pressure pump of the type including a housing assembly defining a pump cavity, and a pair of confronting, axially spaced transverse housing surfaces; a cam ring member disposed between said transverse surfaces, said cam ring member being movable to define a neutral position, and a displaced position in response to rotation of a manual control shaft; a rotor assembly disposed within said cam ring member, and defining a plurality of circumferentially-spaced, radially-extending bores, and a piston member disposed in each of said bores; said housing assembly including means operable to support said rotor assembly relative to said housing assembly, for rotation about an axis; said housing assembly and said support means cooperating to define inlet fluid passage means for directing fluid to certain of said bores, and further cooperating to define outlet fluid passage means for directing fluid from certain other of said bores; characterized by:

(a) said cam ring member defining a transverse surface closely spaced apart from a first one of said confronting, transverse housing surfaces;

(b) said transverse surface of said cam ring member defining neutral fluid passage means in fluid communication with said pump cavity defined by said housing assembly;

(c) said housing assembly and said support means cooperating to define a high pressure fluid passage means in fluid communication with said outlet fluid passage means, including a restricted opening in said first transverse housing surface; and (d) said restricted opening being disposed such that, when said cam ring member is in said displaced position, fluid communication from said restricted opening to said neutral fluid passage means is substantially prevented and, as said cam ring member is displaced from said displaced position toward said neutral position, fluid communication from said restricted opening to said neutral fluid passage means is gradually opened.

2. A rotary fluid pressure pump as claimed in claim 1 characterized by said restricted opening and said neutral fluid passage means being sized such that fluid pressure in said high-pressure fluid passage means is below a predetermined maximum pressure whenever said cam ring member is within a predetermined displacement of said neutral position.

3. A rotary fluid pressure pump as claimed in claim 2 characterized by said predetermined pressure being approximately 100 psi. and said predetermined displacement being approximately 0.6 degrees of displacement of said control shaft.

4. A rotary fluid pressure pump as claimed in claim 1 characterized by said restricted opening being in the range of about 0.033 inches to about 0.043 inches in diameter, and said neutral fluid passage means having a width in the range of about 0.080 inches to about 0.100 inches.

5. A rotary fluid pressure pump as claimed in claim 1 characterized by said housing assembly comprising a cover member and a body member, said body member defining said first transverse housing surface.

6. A rotary fluid pressure pump as claimed in claim 5 characterized by said support means comprises said body member including a generally cylindrical portion, said rotor assembly including a rotor member disposed on said cylindrical portion and operable to rotate relative thereto.

7. A rotary fluid pressure pump as claimed in claim 6 characterized by said cylindrical portion of said body member defines at least a portion of said inlet and outlet fluid passage means, and said body member defines said high-pressure fluid passage means.

8. A rotary fluid pressure pump as claimed in claim 5 characterized by said body member including a dampening shoe, axially displaceable relative to said body member, said dampening shoe being biased, by fluid pressure in said high pressure fluid passage means, into engagement with said transverse surface of said cam ring member, said dampening shoe defining said restricted opening.

9. A variable displacement, rotary fluid pressure pump of the type including a housing assembly defining a pump cavity and a pair of confronting, axially spaced transverse housing surfaces; a cam ring member disposed between said transverse surfaces, said cam ring member defining a neutral position and being movable in a first direction from neutral toward a first displaced position, and in a second direction from neutral toward a second displaced position; a rotor assembly disposed within said cam ring member, and defining a plurality of circumferentially-spaced, radially-extending bores, and a piston member disposed in each of said bores; said housing assembly including means operable to support said rotor assembly relative to said housing assembly, for rotation about an axis; said support means defining a first fluid passage means for directing pressurized fluid from certain of said bores when said cam ring member is in said first displaced position, and a second fluid passage means for directing pressurized fluid from certain other of said bores when said cam ring is in said second displaced position; characterized by:

(a) said cam ring member defining a transverse surface closely spaced apart from a first one of said confronting, transverse housing surfaces;

(b) said transverse surface of said cam ring member defining first and second neutral fluid passages in fluid communication with said pump cavity defined by said housing assembly;

(c) said housing assembly defining a first pressure passage in fluid communication with said first fluid passage means, and a second pressure passage in fluid communication with said second fluid passage means, said first and second pressure passages including first and second restricted openings, respectively; and (d) said first and second restricted openings being disposed such that, when said cam ring member is in said first displaced position, fluid communication from said first restricted opening to said first neutral fluid passage is substantially prevented, and as said cam ring member is moved from said first displaced position toward said neutral position, said first restricted opening gradually begins to communicate with said first neutral fluid passage; and when said cam ring member is in said second displaced position, fluid communication from said second restricted opening to said second neutral fluid passage is substantially prevented and as said cam ring member is moved from said second displaced position toward said neutral position, said second restricted opening gradually begins to communicate with said second neutral fluid passage.

* * * * *